US006954026B2

(12) United States Patent
Etou

(10) Patent No.: US 6,954,026 B2
(45) Date of Patent: Oct. 11, 2005

(54) COLOR CATHODE RAY TUBE HAVING VARIABLE APERTURES IN A SHADOW MASK

(75) Inventor: Hideaki Etou, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 100 days.

(21) Appl. No.: 10/454,863

(22) Filed: Jun. 5, 2003

(65) Prior Publication Data

US 2003/0230962 A1 Dec. 18, 2003

(30) Foreign Application Priority Data

Jun. 12, 2002 (JP) ..... 2002-170873
Apr. 11, 2003 (JP) ..... 2003-108284

(51) Int. Cl.[7] ..... H01J 29/07; H01J 29/81
(52) U.S. Cl. ..... 313/403; 313/408
(58) Field of Search ..... 313/402–408; 445/47; 430/5, 23

(56) References Cited

U.S. PATENT DOCUMENTS 3,652,895 A * 3/1972 Tsuneta et al. ..... 313/403
3,844,005 A * 10/1974 Yamada et al. ..... 445/47
4,296,189 A * 10/1981 Kuzminski ..... 430/5
5,086,250 A * 2/1992 Van Der Waal ..... 313/403
5,280,215 A * 1/1994 Ohtake et al. ..... 313/403
6,124,668 A * 9/2000 Shoda ..... 313/403

FOREIGN PATENT DOCUMENTS

| | | |
|---|---|---|
| JP | 63-43241 | 2/1988 |
| JP | 2001-84918 | 3/2001 |
| KR | 1998-020588 | 6/1998 |
| KR | 2002-0034503 | 5/2002 |

* cited by examiner

*Primary Examiner*—Karabi Guharay
(74) *Attorney, Agent, or Firm*—Merchant & Gould P.C.

(57) ABSTRACT

Each of a plurality of arrays of apertures of a shadow mask has a vertically long aperture, a vertically short aperture and a bridge between these apertures. In each of the arrays of apertures, one long aperture and one or more short apertures are arranged alternately, and a horizontal maximum width $H_{Smax}$ of the short aperture is larger than a horizontal basic width $H_L$ of the long aperture. This makes it possible to provide a color cathode ray tube having an improved brightness without causing moiré fringes, color displacement, breaking of the shadow mask or variation in color purity.

12 Claims, 16 Drawing Sheets

COLOR CATHODE RAY TUBE HAVING VARIABLE APERTURES IN A SHADOW MASK

BACKGROUND OF THE INVENTION

1. Field of the Invention

The present invention relates to a color cathode ray tube that is used preferably as a television receiver or a computer display.

2. Description of Related Art

In a color cathode ray tube, electron beams emitted from an electron gun pass through apertures formed in a shadow mask, and then strike a phosphor screen, thus causing a phosphor to emit light.

As shown in FIG. 15, a shadow mask 95 is welded to a mask frame 96 such that tension is applied in a direction indicated by arrows 9 (a vertical direction, i.e., a Y-axis direction). The shadow mask 95 is provided with a large number of apertures 90, through which electron beams pass and reach a phosphor screen.

In such a tension-type shadow mask 95, the apertures 90 formed in the shadow mask 95 are shaped and arranged as follows. In general, a large number of substantially equi-shaped slot apertures 90 are aligned such that their longitudinal directions correspond to the vertical direction as shown in FIG. 16.

During an operation of the color cathode ray tube, the shadow mask 95 is heated by the electron beams and expands. Although the thermal expansion in the vertical direction is absorbed by the tension applied to the shadow mask 95, the thermal expansion in the horizontal direction is transmitted horizontally via bridges 91, causing so-called doming. For preventing this doming, it is preferable that a vertical pitch of the bridges 91 is large. When the vertical pitch of the bridges 91 is increased, the resultant increase in an aperture area improves brightness of a displayed image. However, there is a problem that the interference between the regularly arranged bridges 91 and horizontal scanning lines causes moiré fringes, deteriorating an image quality.

In order to solve this problem, JP 2001-84918 A discloses a technology in which a pair of vertical sides of each of the apertures 90 in the shadow mask 95 are formed to have protrusions and depressions. FIG. 17 is a schematic view showing the shadow mask 95, a phosphor screen 2*a* and electron beams 94 that have passed through the apertures 90 of the shadow mask 95 (passed beams 94), seen from an electron gun side.

With this technology, a plurality of protrusions 92 that protrude inward from the pair of vertical sides of the apertures 90 serve as pseudo-bridges. Therefore, even when the vertical pitch of the bridges 91 is extended, it is possible to suppress the generation of moiré fringes caused by the interference between the bridges 91 and the scanning lines. Furthermore, since the number of the bridges 91 can be reduced, the heat is not easily transmitted horizontally via the bridges 91, so that the displacement of the shadow mask apertures owing to doming can be suppressed, thus achieving an effect of preventing color displacement.

Moreover, JP 63(1988)-43241 A suggests that, for preventing breaking of the shadow mask and improving brightness, two kinds of apertures 90*a* and 90*b* having different vertical lengths can be aligned in combination as shown in FIG. 18.

However, the above-described conventional technologies respectively have the following problems.

In the technology illustrated in FIG. 17, phosphor lines 12 in the phosphor screen 2*a* are substantially straight lines, whereas the passed beams 94 have substantially the same shapes as the apertures 90 because the electron beams are blocked by the bridges 91 and the protrusions (pseudo-bridges) 92. Accordingly, non-light-emitting portions are formed in the phosphor lines 12. In general, a higher brightness per unit electric current is desirable in a cathode ray tube, and this can be achieved effectively by removing the non-light-emitting portions. However, with the technology shown in FIG. 17, it has been difficult to increase the brightness because of the bridges 91 and a large number of the protrusions 92. Reducing the vertical width of the bridges 91 can achieve a smaller area of the non-light-emitting portions, but this is problematic in that, owing to a large vertical pitch of the bridges 91, a sufficient mechanical strength cannot be achieved, so that the bridges 91 break easily. Furthermore, reducing the vertical width of the plurality of the protrusions 92 also can achieve a smaller area of the non-light-emitting portions, but there arises a problem that it is difficult to form narrow protrusions 92 with a high dimensional accuracy, so that a variation in color purity is generated.

In addition, a general method for forming the phosphor lines 12 is an exposure method of forming the phosphor lines 12 by exposure using the shadow mask 95 as a mask. In this exposure method, the widths of the phosphor lines to be formed vary with illumination. In the technology illustrated in FIG. 18, since the two apertures 90*a* and 90*b* have equal horizontal widths, the illumination of light that has passed through the short aperture 90*b*, in which a pair of the bridges 91 at both ends in the vertical direction are positioned closer, is smaller than the illumination of light that has passed through the long aperture 90*a*, in which a pair of the bridges 91 are positioned farther. This causes a difficulty in forming the phosphor lines 12 with equal widths by the exposure method.

SUMMARY OF THE INVENTION

It is an object of the present invention to solve the above-described conventional problems and to provide a color cathode ray tube having an improved brightness without causing moiré fringes, color displacement, breaking of the shadow mask or variation in color purity. It is a further object of the present invention to provide a color cathode ray tube including phosphor lines with equal widths.

In order to achieve the above-mentioned objects, a color cathode ray tube according to the present invention includes a panel whose inner surface is provided with a phosphor screen, and a shadow mask facing the phosphor screen. The shadow mask has a plurality of arrays of apertures, and the arrays of apertures have a vertically long aperture, a vertically short aperture and a bridge between these apertures. In each of the arrays of apertures, one long aperture and one or more short apertures are arranged alternately, and the one long aperture is the vertically long aperture and the one or more short apertures each is the vertically short aperture. A horizontal maximum width $H_{Smax}$ of the short aperture is larger than a horizontal basic width $H_L$ of the long aperture.

DESCRIPTION OF THE PREFERRED EMBODIMENTS

In a color cathode ray tube of the present invention, in each of the arrays of apertures of the shadow mask, one long aperture and one or more short apertures are arranged alternately. Thus, the vertical spacing between two bridges that sandwich the short aperture in the vertical direction is small. Accordingly, even when the vertical width of each bridge is reduced, it is possible to secure a mechanical strength necessary for the shadow mask. Also, since the vertical width of the bridge can be reduced, the brightness of a displayed image improves.

On the other hand, the spacing between the two bridges that sandwich the long aperture in the vertical direction is extended. In other words, there are both portions with a narrow spacing between the bridges and that with a wide spacing between the bridges in the vertical direction. This makes it possible to suppress the transmission of heat and thermal expansion in the horizontal direction, thereby preventing color displacement due to doming.

Figure 17:
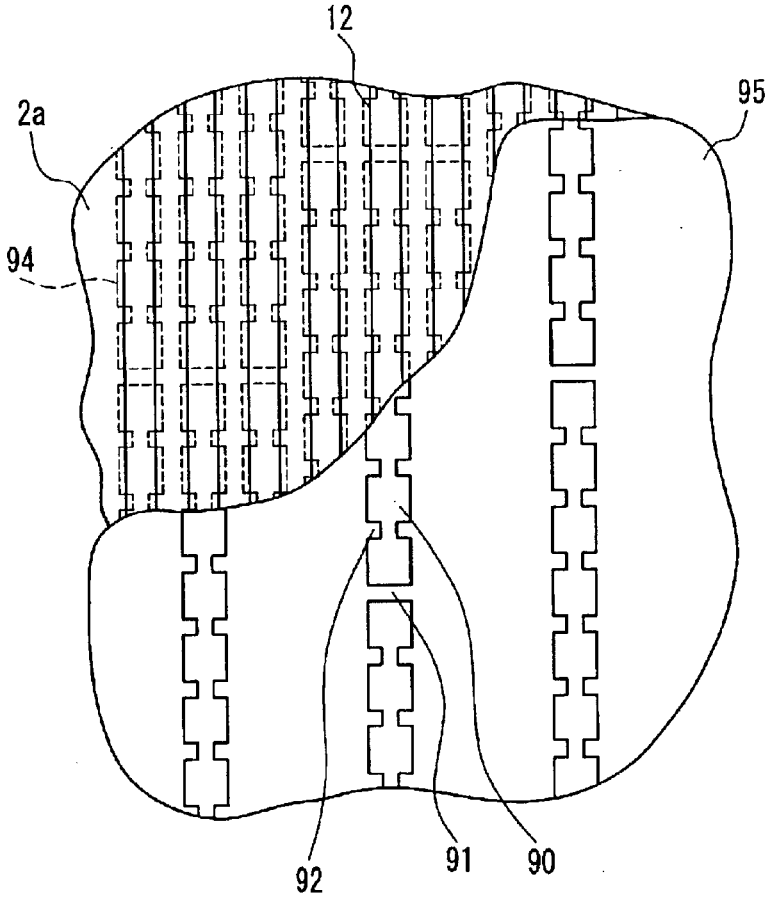
FIG. 17 PRIOR ART
FIG. 17 is a schematic broken view showing a shadow mask, a phosphor screen and passed beams, which are electron beams that have passed through apertures and reached the phosphor screen, seen from an electron gun side in another conventional color cathode ray tube.

Also, since one long aperture and one or more short apertures are arranged alternately along the vertical direction, the arrangement of the bridges becomes less regular, thus suppressing the generation of moiré fringes. Consequently, the protrusions 92 as shown in FIG. 17 do not have to be formed. Accordingly, the color purity does not drop due to a dimensional variation in the protrusions 92. Furthermore, since the protrusions do not have to be formed, the brightness improves further.

Moreover, a horizontal maximum width $H_{Smax}$ of the short aperture is larger than a horizontal basic width $H_L$ of the long aperture. Therefore, the difference in illumination caused between the long aperture and the short aperture by the difference in their vertical widths can be reduced, making it possible to form phosphor lines with a constant width by an exposure method. Here, the horizontal basic width $H_L$ of the long aperture is defined as follows. When the long aperture has a substantially constant horizontal width, the horizontal basic width $H_L$ of the long aperture means this horizontal width, while when the long aperture has a horizontal width varying in the vertical direction, the horizontal basic width $H_L$ of the long aperture means a horizontal width of a portion whose horizontal width is substantially constant over a longest range in the vertical direction.

In the above-described color cathode ray tube of the present invention, it is preferable to satisfy $0.9<S_1/S_2<1.1$, wherein $S_1$ represents a total area of all the bridges sandwiched between two long apertures that are closest in a vertical direction and $S_2$ represents a total area of the portions of all the short apertures, sandwiched between the two long apertures, that protrude horizontally outward beyond extensions of a pair of basic vertical sides defining the horizontal basic width $H_L$ of the long aperture. This makes it possible to form the phosphor lines with a still more constant width by an exposure method.

Moreover, in the above-described color cathode ray tube of the present invention, it is preferable that a vertical spacing $P_{BV}$ between horizontal center lines is substantially constant, where the horizontal center lines are each defined as a line passing through a center in a vertical direction of each of the bridges in the shadow mask. This makes black streaks less visible without reducing the vertical width of the bridges. Further, since there is no need to reduce the vertical width of the bridges, the mechanical strength of the shadow mask can be secured, and geomagnetic characteristics do not deteriorate.

The following is a description of a color cathode ray tube of the present invention, with reference to the accompanying drawings.

Figure 1:
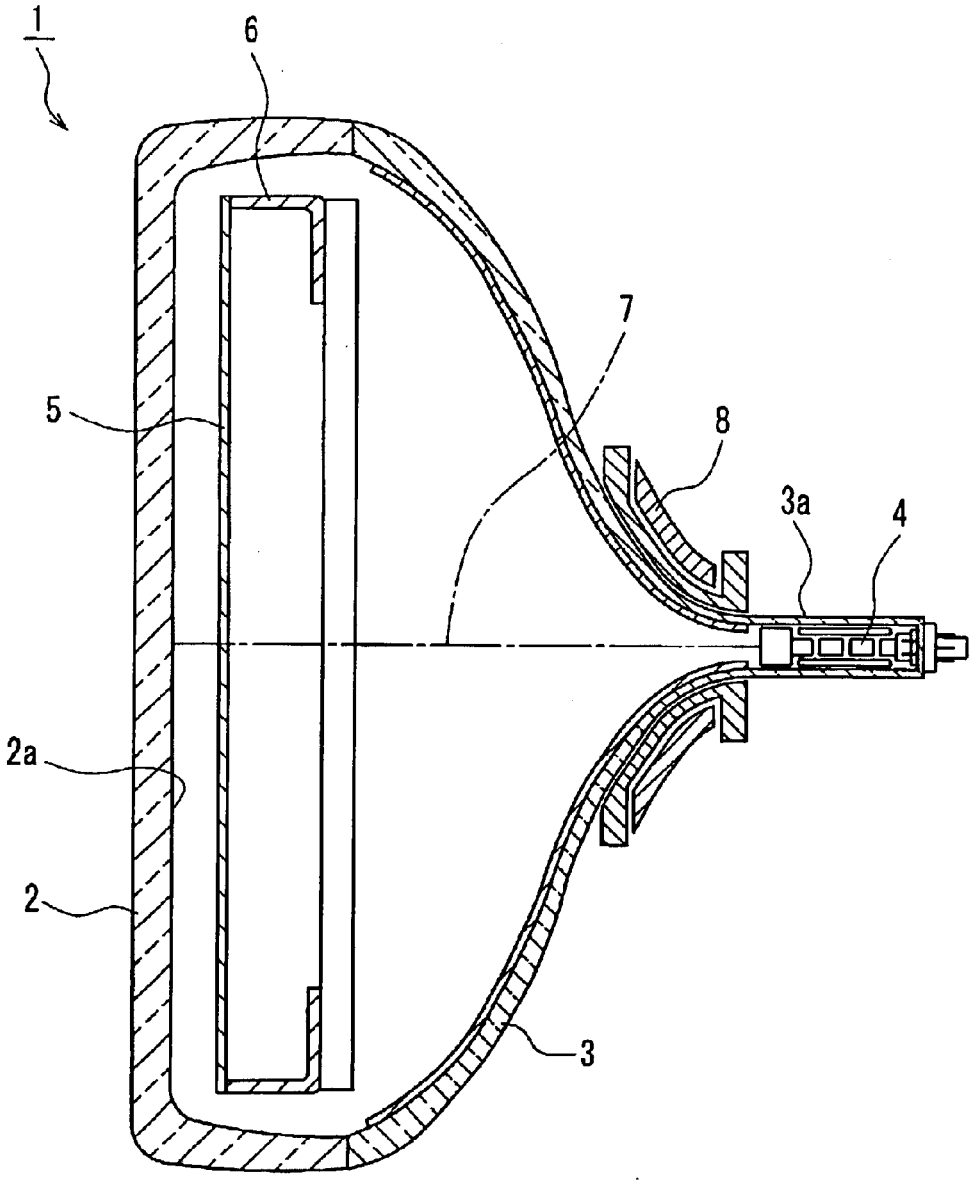
FIG. 1 is a lateral cross-sectional view showing an embodiment of a color cathode ray tube of the present invention.

FIG. 1 illustrates an embodiment of the color cathode ray tube of the present invention. A color cathode ray tube 1 has an envelope including a funnel 3 and a panel 2 on whose inner surface a phosphor screen 2*a* is formed. An electron gun 4 is provided in a neck portion 3*a* of the funnel 3. A shadow mask 5 facing the phosphor screen 2*a* is supported by a mask frame 6, which is attached to a panel pin (not shown) provided on an inner wall of the panel 2 via a spring (not shown). Further, outside the funnel 3, a deflection yoke 8 is provided for deflecting and scanning three electron beams 7 emitted from the electron gun 4.

First Embodiment

Figure 2:
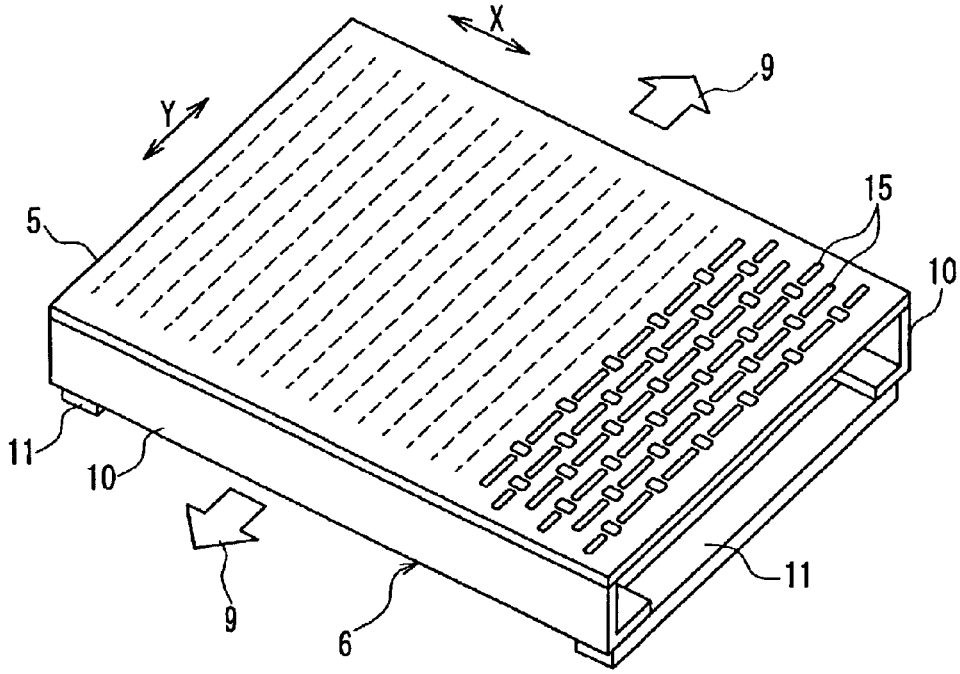
FIG. 2 is a perspective view showing an assembly including a shadow mask and a mask frame in a color cathode ray tube according to a first embodiment of the present invention.

FIG. 2 shows an assembly including the shadow mask 5 and the mask frame 6 according to the first embodiment. The mask frame 6 is constituted such that an opposing pair of supports 10 serving as long sides and a pair of elastic members 11 serving as short sides are fixed so as to form a rectangular frame. The shadow mask 5 is welded to the supports 10 with a tension applied in a direction indicated by arrows 9 (a vertical direction, i.e., a Y-axis direction). In a horizontal direction (an X-axis direction) of the shadow mask 5, there are a large number of columnar arrays of apertures 15. Each array of apertures 15 includes vertically aligned apertures for passing electron beams.

Figure 3:
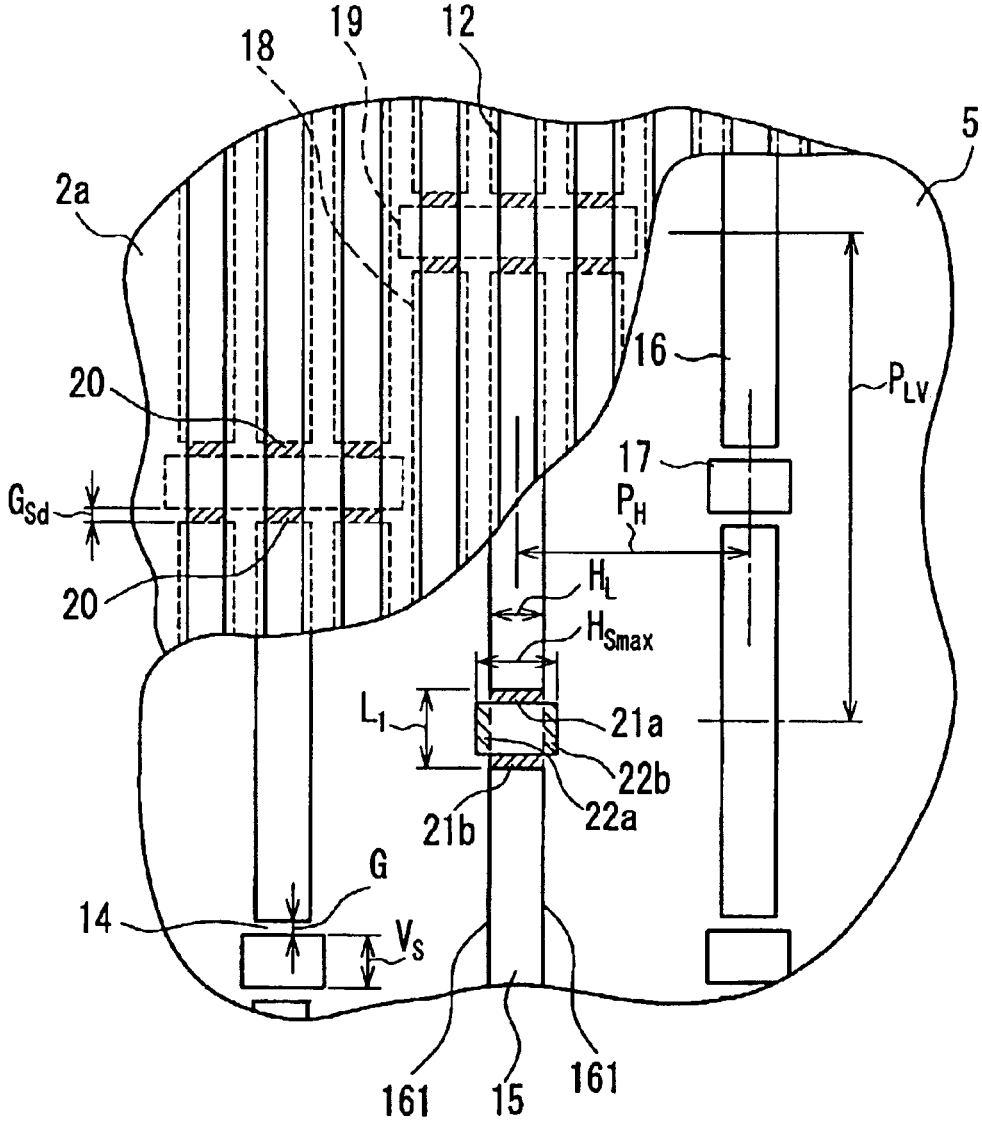
FIG. 3 is a schematic broken view showing the shadow mask, a phosphor screen and passed beams, which are electron beams that have passed through apertures and reached the phosphor screen, seen from an electron gun side in the color cathode ray tube according to the first embodiment of the present invention.

FIG. 3 is a broken schematic view showing the shadow mask 5, the phosphor screen 2*a* and passed beams, which are the electron beams that have passed through apertures and reached the phosphor screen 2*a*, seen from an electron gun side in the color cathode ray tube according to the present embodiment. The phosphor screen 2*a* is provided with a large number of vertically aligned striped phosphor lines 12. One array of apertures 15 of the shadow mask 5 corresponds to three phosphor lines 12. When the electron beams pass through apertures 16 and 17 of the shadow mask 5 and reach the phosphor screen 2*a* as passed beams 18 and 19, the phosphor lines 12 are illuminated. Since the electron beams are blocked by bridges 14 partitioning off two vertically adjacent apertures of the shadow mask 5, no electron beam reaches the regions on the phosphor lines 12 corresponding to the bridges 14, so that non-light-emitting portions 20 are formed.

The present embodiment can minimize the area of these non-light-emitting portions 20. A specific description thereof follows.

In the present embodiment, as the apertures for passing electron beams of the shadow mask 5, vertically elongated apertures 16 whose width in the vertical direction (the Y-axis direction) is larger than that in the horizontal direction (the X-axis direction) (in the following, simply referred to as "long apertures 16") and short apertures 17 whose vertical width is smaller than that of the long apertures 16 (in the following, simply referred to as "short apertures 17") are formed. In the embodiment illustrated in FIG. 3, one long aperture 16 and one short aperture 17 are formed alternately in each array of apertures 15.

Accordingly, in each array of apertures 15, two bridges 14 that sandwich the short aperture 17 in the vertical direction are located close to each other. The synergistic effect of these two closely-located bridges 14 strengthens the shadow mask 5, so that a mechanical strength necessary for the shadow mask 5 can be secured even when a vertical width G of each bridge 14 is reduced compared with the conventional case.

Also, since the vertical width G of the bridge 14 can be reduced, a vertical width $G_{sd}$ of the non-light-emitting portion 20 generated by a shadow of the bridge 14 can be reduced. This enhances brightness.

Moreover, because of the small vertical width G of the bridge 14, the shadow of the bridge 14 is hardly noticeable. Thus, even when the vertical pitch of the apertures is extended so as to reduce the number of the bridges 14 in each array of apertures 15 for the purpose of suppressing color displacement caused by thermal expansion, there are less moiré fringes generated owing to the interference between the scanning lines and the bridges 14. This eliminates the need for a complicated aperture shape in which, as in the conventional technology illustrated in FIG. 17, a plurality of the protrusions 92 that protrude inward are provided on the vertical sides of the apertures.

Furthermore, a horizontal maximum width $H_{Smax}$ of the short aperture 17 is larger than a horizontal basic width $H_L$ of the long aperture 16. A general method for forming the phosphor lines 12 is an exposure method of forming the phosphor lines 12 by exposure using the shadow mask 5 as a mask. In this exposure method, the widths of the phosphor lines to be formed vary with illumination. When all the apertures have equal horizontal widths, the illumination of light that has passed through the short aperture with a narrow spacing between the bridges is smaller than the illumination of light that has passed through the long aperture with a wider spacing between the bridges. In the present embodiment, since the horizontal maximum width $H_{Smax}$ of the short aperture 17 is larger than the horizontal basic width $H_L$ of the long aperture 16, the difference in illumination caused between the long aperture 16 and the short aperture 17 by the difference in their vertical widths can be reduced, making it possible to form the phosphor lines 12 with a constant width.

Here, as shown in FIG. 3, a pair of vertical sides 161 defining the horizontal basic width $H_L$ of the long aperture 16 is referred to as basic vertical sides. When $S_1$ represents a total area of portions 21*a* and 21*b*, located between extensions of the pair of basic vertical sides 161, of all the bridges 14 sandwiched between the two long apertures 16 that are closest in the vertical direction and $S_2$ represents a total area of portions 22*a* and 22*b* of the short aperture 17 that protrude horizontally outward beyond the extensions of the pair of basic vertical sides 161, it is desirable that $0.9<S_1/S_2<1.1$ be satisfied. In this manner, when forming the phosphor lines 12 by the exposure method, it becomes possible to compensate for the illumination of light in the portions of the short apertures 17 and the bridges 14, thereby achieving substantially constant widths of the phosphor lines 12.

Further, $L_1$ represents the vertical distance between the two long apertures 16 that are closest in the vertical direction ($L_1=V_S+2G$ in the case of FIG. 3, where G is the vertical width of the bridge 14 and $V_S$ is the vertical width of the short aperture 17), $\lambda_Y$ represents a vertical magnification of the passed beam 18 or 19 on the phosphor screen with respect to the aperture 16 or 17 of the shadow mask 5, and Y represents a relative amount of vertical move when exposure is performed while reciprocating one of the shadow mask 5 and the panel 2 relative to the other in the vertical direction in the case of forming the phosphor lines 12 by the exposure method, and at this time, it is desirable that $L_1<\lambda_Y\times Y$ be satisfied. In this way, even when the horizontal maximum width $H_{Smax}$ of the short aperture 17 is extended, the illumination of light that has passed through the short aperture 17 does not increase excessively so as to expand the widths of the phosphor lines 12 locally. Thus, the widths of the phosphor lines 12 can be made substantially constant.

Additionally, it is preferable that the horizontal basic width $H_L$ of the long aperture 16 and the horizontal maximum width $H_{Smax}$ of the short aperture 17 satisfy $1.0\leqq H_{Smax}/H_L\leqq 1.5$. If the horizontal widths of the passed beams 18 and 19 that pass through the apertures 16 and 17 of the shadow mask 5 and reach the phosphor screen are too large, it is likely that the beams illuminate not only the phosphor lines with colors to be illuminated but also those with the other colors, which may lead to color displacement and white quality degradation. For preventing these phenomena, it is preferable to set the horizontal maximum width $H_{Smax}$ so as to satisfy the above formula.

Furthermore, in order for the shadow of the bridge 14 to be less noticeable, it is desirable that the vertical width $G_{sd}$ of the non-light-emitting portion 20 generated by the bridge 14 satisfies $G_{sd}$<an effective vertical width of the phosphor screen/the number of scanning lines×0.05. It is preferable that the vertical width G of the bridge 14 is determined so as to satisfy the above relationship.

Figure 4:
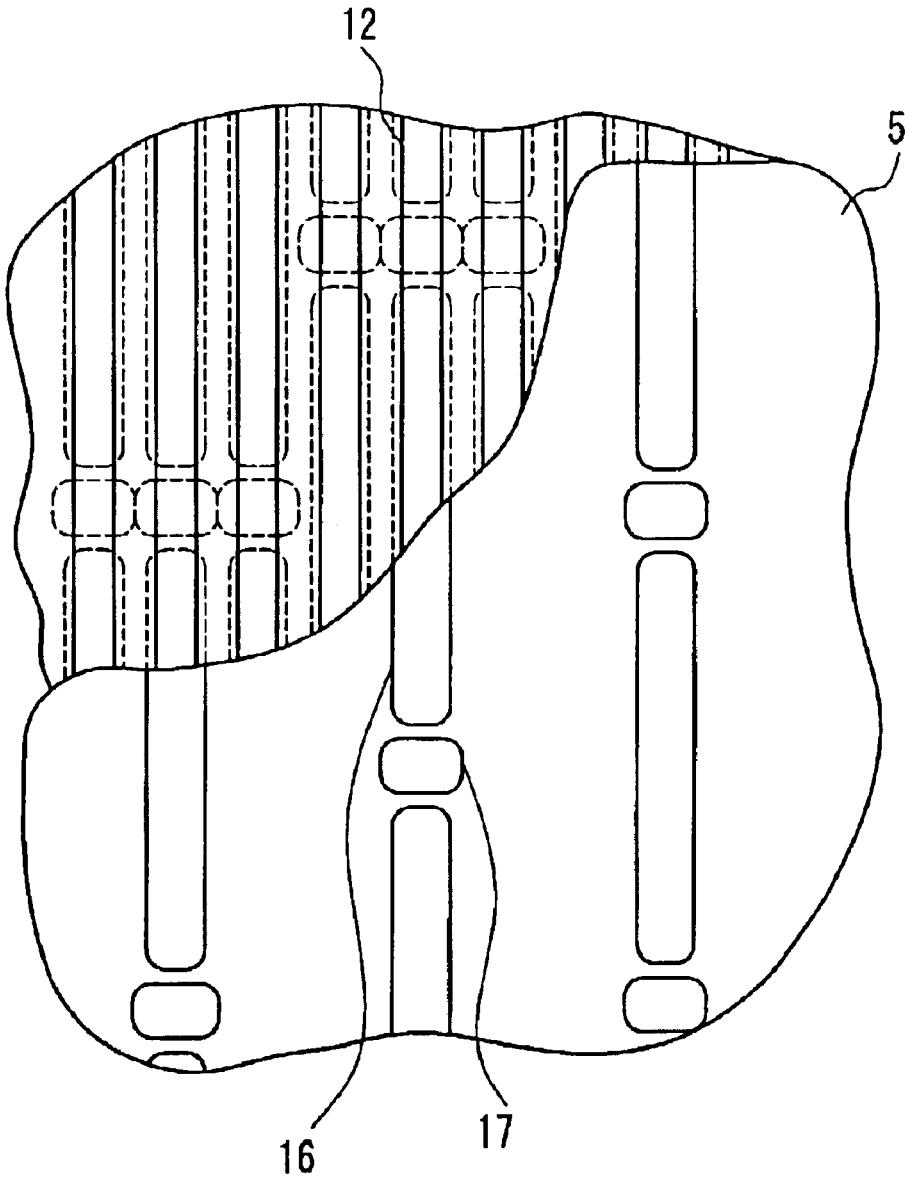
FIG. 4 is a schematic broken view showing the shadow mask, a phosphor screen and passed beams, which are electron beams that have passed through apertures and reached the phosphor screen, seen from an electron gun side in another color cathode ray tube according to the first embodiment of the present invention.

Although the long aperture 16 and the short aperture 17 both have a rectangular shape in FIG. 3, they also may have a slightly round shape as shown in FIG. 4. Since the apertures in the shadow mask 5 generally are formed by etching, they do not have a perfect rectangular shape but sometimes have a shape with four round corners.

Figure 5:
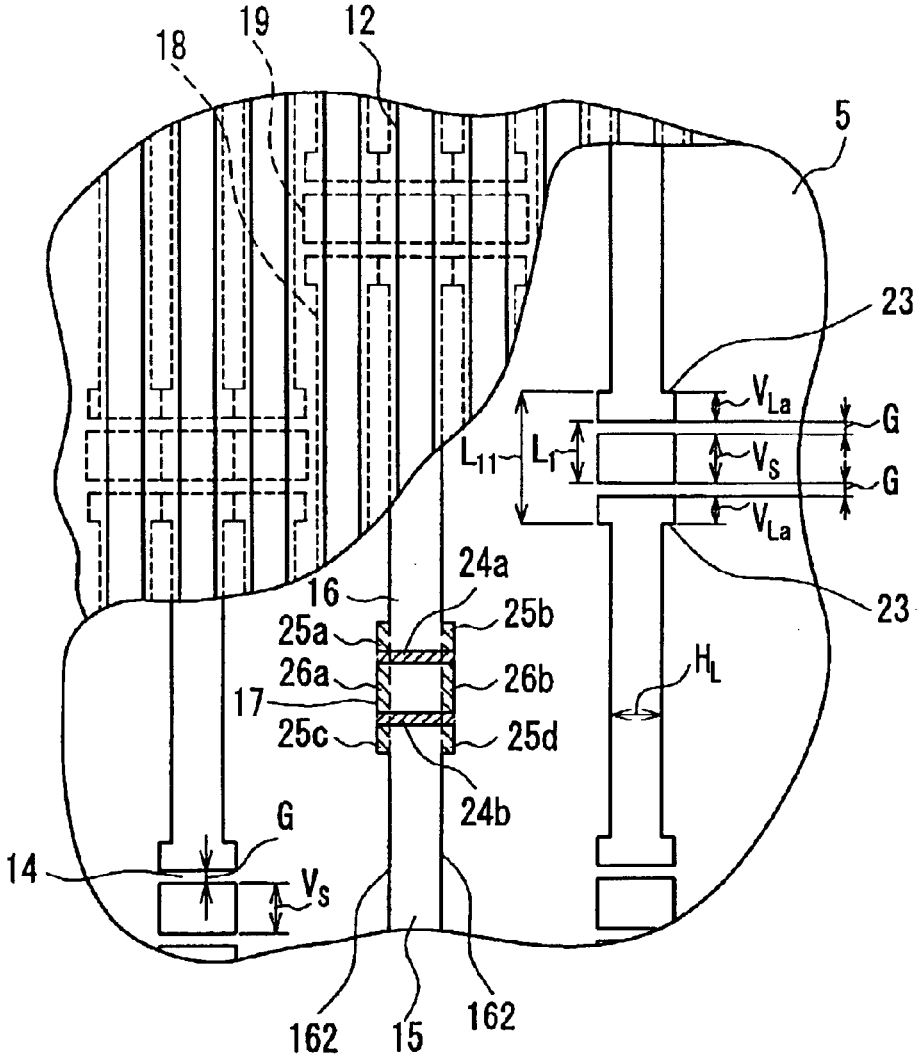
FIG. 5 is a schematic broken view showing the shadow mask, a phosphor screen and passed beams, which are electron beams that have passed through apertures and reached the phosphor screen, seen from an electron gun side in yet another color cathode ray tube according to the first embodiment of the present invention.

The long aperture 16 does not have to have a rectangular shape as shown in FIG. 3, but may have a substantially "I" shape by forming outwardly protruding portions 23 protruding beyond a pair of basic vertical sides 162 defining the horizontal basic width $H_L$ of the long aperture 16 so that the horizontal width of the long aperture 16 are expanded at both ends in the vertical direction or their vicinities as shown in FIG. 5. In this case, $S_{11}$ represents a total area of portions 24*a* and 24*b* corresponding to all the bridges 14 sandwiched between the two long apertures 16 that are closest in the vertical direction, and $S_{22}$ represents a total area of portions 25*a*, 25*b*, 25*c* and 25*d* of the long apertures 16 corresponding to the protruding portions 23 that protrude horizontally outward beyond the extensions of the pair of basic vertical sides 162 and portions 26*a* and 26*b* of the short aperture 17 that protrude horizontally outward beyond the extensions of the pair of basic vertical sides 162. At this time, it is desirable that $0.9<S_{11}/S_{22}<1.1$ be satisfied. In this manner, when forming the phosphor lines 12 by the exposure method, it becomes possible to compensate for the illumination of light in the portions of the short apertures 17 and the bridges 14, thereby achieving substantially constant widths of the phosphor lines 12.

Also, $L_1$ represents the vertical distance between the two long apertures 16 that are closest in the vertical direction ($L_1=V_S+2G$ in the case of FIG. 5, where G is the vertical width of the bridge 14 and $V_S$ is the vertical width of the short aperture 17). When $V_{La}$ represents the vertical width of the protruding portion 23, the total vertical length $V_{LaT}$ of portions having a horizontal width larger than the horizontal basic width $H_L$ in the long apertures 16 is $V_{LaT}=2V_{La}$ in the case of FIG. 5. Accordingly, the vertical length $L_{11}$ of the wider portion is defined by $L_{11}=L_1+V_{LaT}$. Further, $\lambda_Y$ represents a vertical magnification of the passed beam 18 or 19 on the phosphor screen with respect to the aperture 16 or 17 of the shadow mask 5, and Y represents a relative amount of vertical move when exposure is performed while reciprocating one of the shadow mask 5 and the panel 2 relative to the other in the vertical direction in the case of forming the phosphor lines 12 by the exposure method. At this time, it is desirable that $L_{11}<\lambda_Y\times Y$ be satisfied. In this way, even when the protruding portions 23 are provided in the long aperture 16 and the horizontal maximum width $H_{Smax}$ of the short aperture 17 is extended, the illumination of light that has passed through the protruding portions 23 and the short aperture 17 does not increase excessively so as to expand the widths of the phosphor lines 12 locally. Thus, the widths of the phosphor lines 12 can be made substantially constant.

Figure 13:
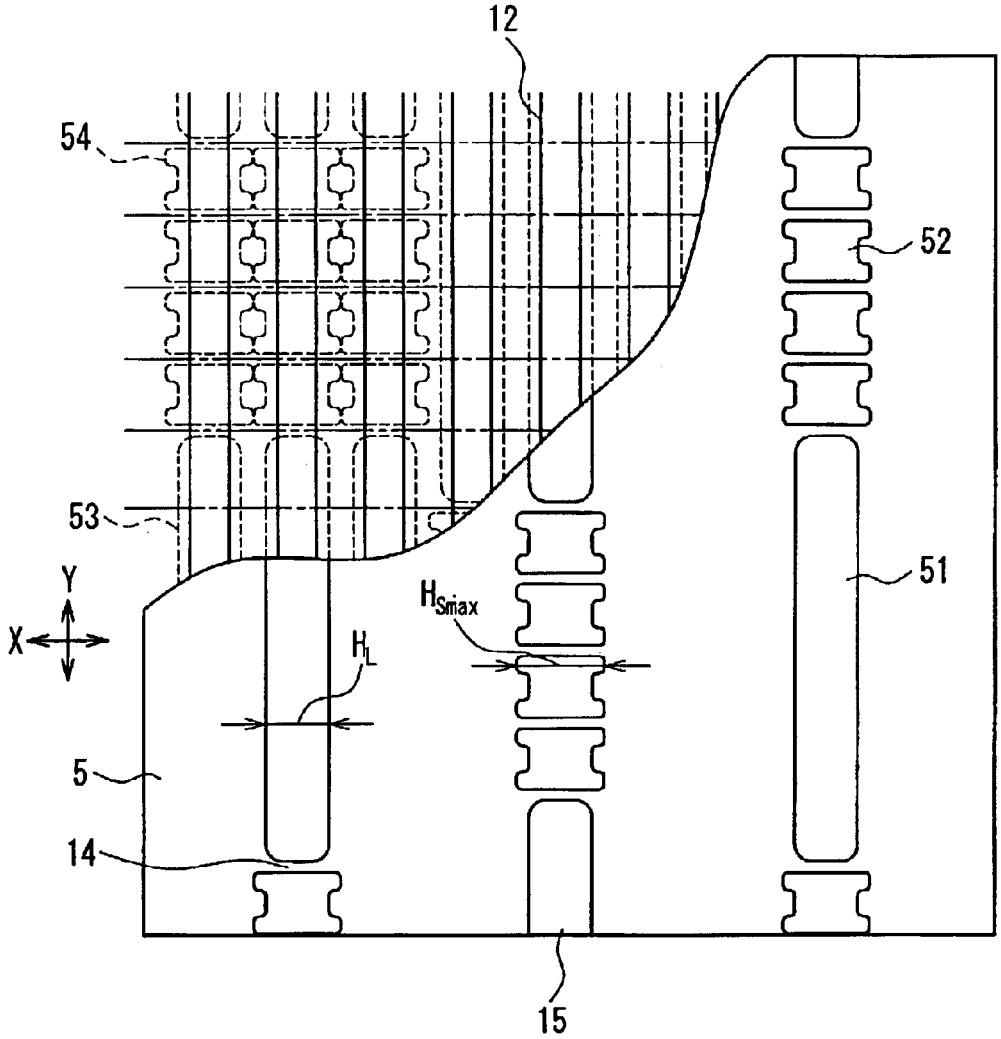
FIG. 13 is a schematic broken view showing a shadow mask, a phosphor screen and passed beams, which are electron beams that have passed through apertures and reached the phosphor screen, seen from an electron gun side in yet another color cathode ray tube according to the second embodiment of the present invention.
Figure 14:
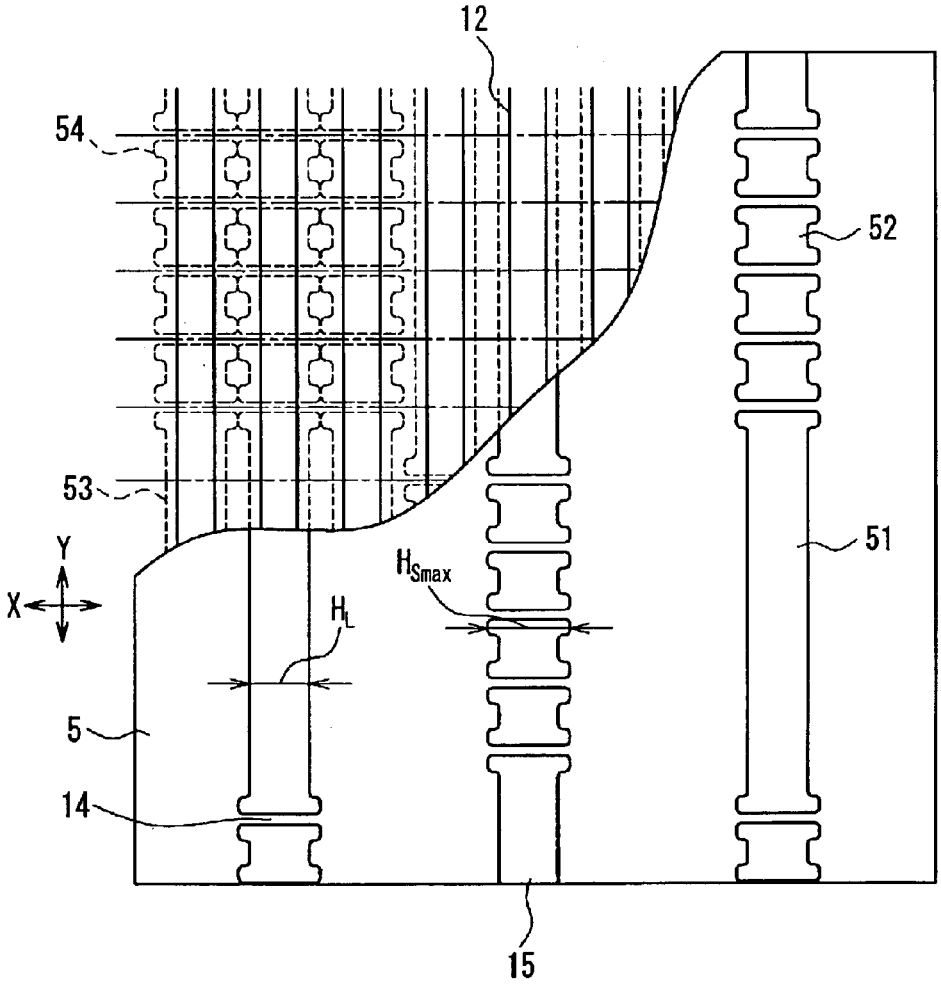
FIG. 14 is a schematic broken view showing a shadow mask, a phosphor screen and passed beams, which are electron beams that have passed through apertures and reached the phosphor screen, seen from an electron gun side in yet another color cathode ray tube according to the second embodiment of the present invention.
Figure 15:
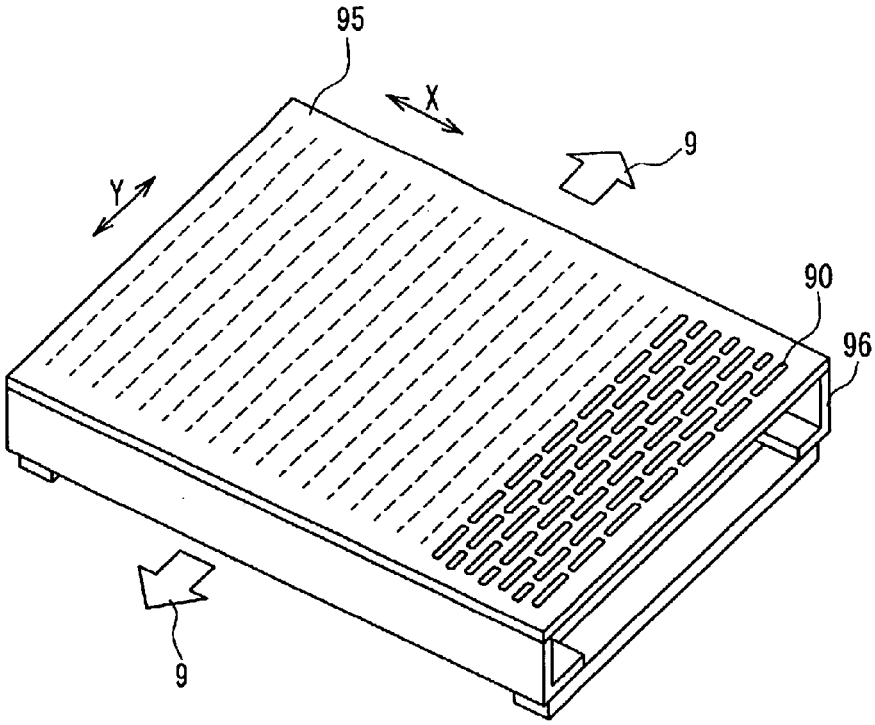
FIG. 15 PRIOR ART
FIG. 15 is a perspective view showing an assembly including a shadow mask and a mask frame in a conventional color cathode ray tube.

The short aperture 17 is not required to have the rectangular shape as in FIGS. 3 and 5 and the slightly round shape as in FIG. 4. For example, as shown in FIGS. 13 and 14 described later, it also may have a substantially "I" shape whose horizontal width in the vicinity of the bridges 14 is slightly larger than that in the central part in the vertical direction.

Figure 6:
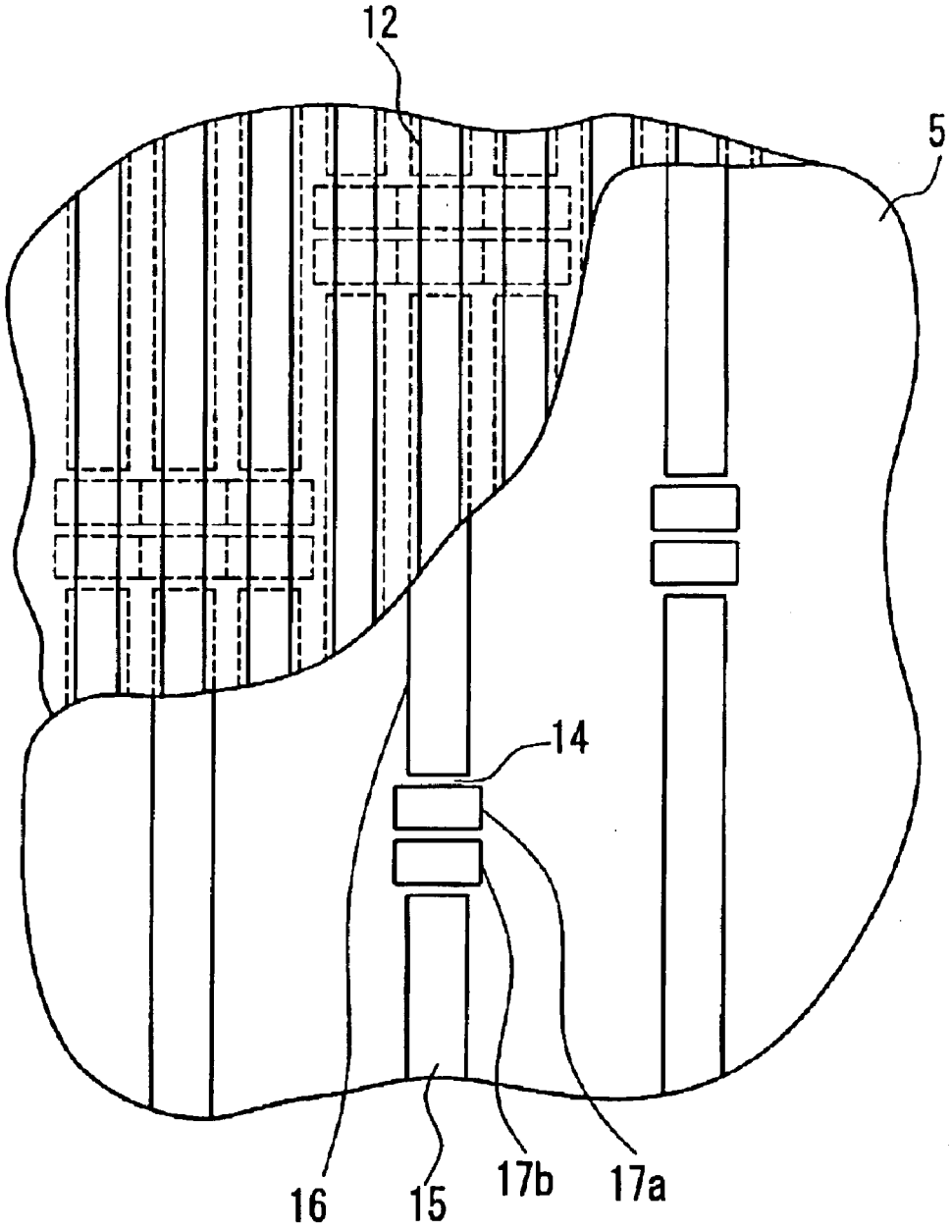
FIG. 6 is a schematic broken view showing the shadow mask, a phosphor screen and passed beams, which are electron beams that have passed through apertures and reached the phosphor screen, seen from an electron gun side in yet another color cathode ray tube according to the first embodiment of the present invention.

Although FIGS. 2 to 5 have illustrated an example in which one long aperture 16 and one short aperture 17 are arranged alternately in each array of apertures 15, there is no particular limitation to this. As shown in FIG. 6, one long aperture 16 and two short apertures 17*a* and 17*b* may be arranged alternately in each array of apertures 15. In this case, three bridges 14 located between the two vertically-adjacent long apertures 16 are arranged close to each other. Thus, the synergistic effect of these three bridges 14 strengthens the shadow mask 5, so that the vertical width of each bridge 14 can be reduced further. Incidentally, the number of the short apertures 17 located between the two vertically-adjacent long apertures 16 is not limited to one or two but may be three or more.

The method for forming the phosphor lines 12 is not limited to the exposure method but may be other methods such as printing.

Next, as a specific example of the first embodiment of the present invention, a color cathode ray tube with a 51-cm-diagonal screen and a deflection angle of 90° will be described.

A shadow mask for the color cathode ray tube of the present example corresponding to the embodiment shown in FIG. 3 had the arrays of apertures 15 with a horizontal pitch $P_H$=0.4 mm, the long apertures 16 with a vertical pitch $P_{LV}$=5.0 mm and a horizontal basic width $H_L$=0.1 mm, the bridges 14 with a vertical width G=0.025 mm, and the short apertures 17 with a horizontal maximum width $H_{Smax}$=0.12 mm and a vertical width $V_S$=0.375 mm. The shadow mask 5 and the phosphor screen 2*a* were spaced apart by 9 mm. In this case, the ratio of the total area $S_1$ of the portions 21*a* and 21*b*, located between the extensions of the pair of basic vertical sides 161, of all the bridges 14 sandwiched between the two long apertures 16 that were closest in the vertical direction to the total area $S_2$ of the portions 22*a* and 22*b* of the short aperture 17 that protrude horizontally outward beyond the extensions of the pair of basic vertical sides 161 was $S_1/S_2$=1.06. Further, the vertical distance $L_1$ between the two long apertures 16 that were closest in the vertical direction was 0.425 mm, which was made sufficiently smaller than the product (0.720) of the vertical magnification $\lambda_Y$=0.03 of the passed beam with respect to the aperture of the shadow mask 5 and the relative amount of vertical move Y=24 mm of the shadow mask 5 or the panel 2 during exposure when forming the phosphor lines 12 by the exposure method. In this manner, it was possible to achieve a substantially constant width of each phosphor line 12.

The vertical width $G_{sd}$ of the shadow 20 of the bridge 14 having a vertical width G of 0.025 mm (the non-light-emitting portion 20) on the phosphor screen 2*a* was 0.012 mm. Since this value was hardly noticeable in a normal use of the color cathode ray tube, the moiré fringes caused by the interference between scanning lines and the non-light-emitting portions 20 were not found visually. In addition, even when the vertical width G of the bridge 14 was as small as 0.025 mm, the synergistic effect of the two bridges 14 sandwiching the short aperture 17 strengthened the shadow mask 5, so that there was little possibility of breaking of the shadow mask 5.

Figure 16:
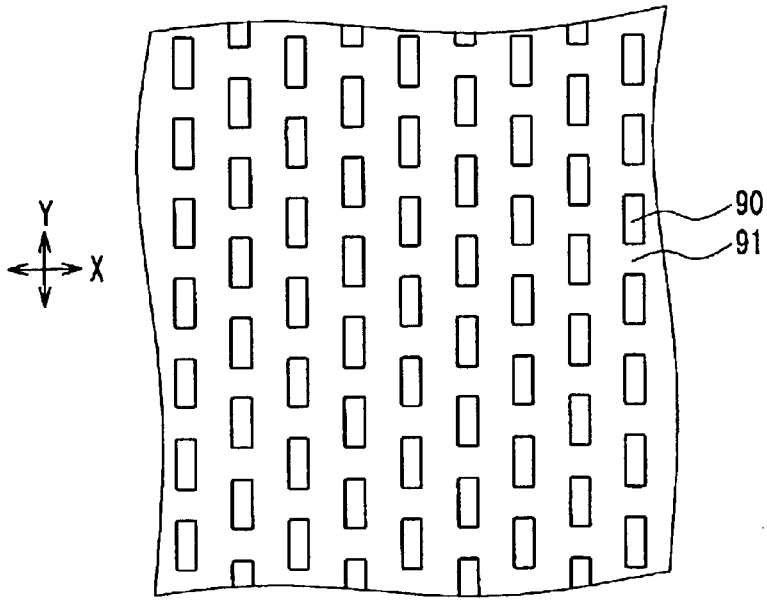
FIG. 16 PRIOR ART
FIG. 16 illustrates an example of the shape and arrangement of apertures formed in the shadow mask in the conventional color cathode ray tube.

When all the apertures had equal vertical widths as in the conventional technologies illustrated in FIGS. 16 and 17, the vertical widths G of the bridges 91 had to be about 0.050 mm for achieving a mechanical strength equivalent to that of the present example. In this case, the vertical width $G_{sd}$ of the shadow of the bridge (the non-light-emitting portion) on the phosphor screen 2*a* was 0.032 mm, which was greater than twice the value of the vertical width $G_{sd}$ of the shadow of the bridge 14 of the present example. Consequently, it was found that, according to the present invention, the shadow of the bridges was not noticeable and the effects of preventing moiré fringes and improving brightness were achieved.

Second Embodiment

Figure 7:
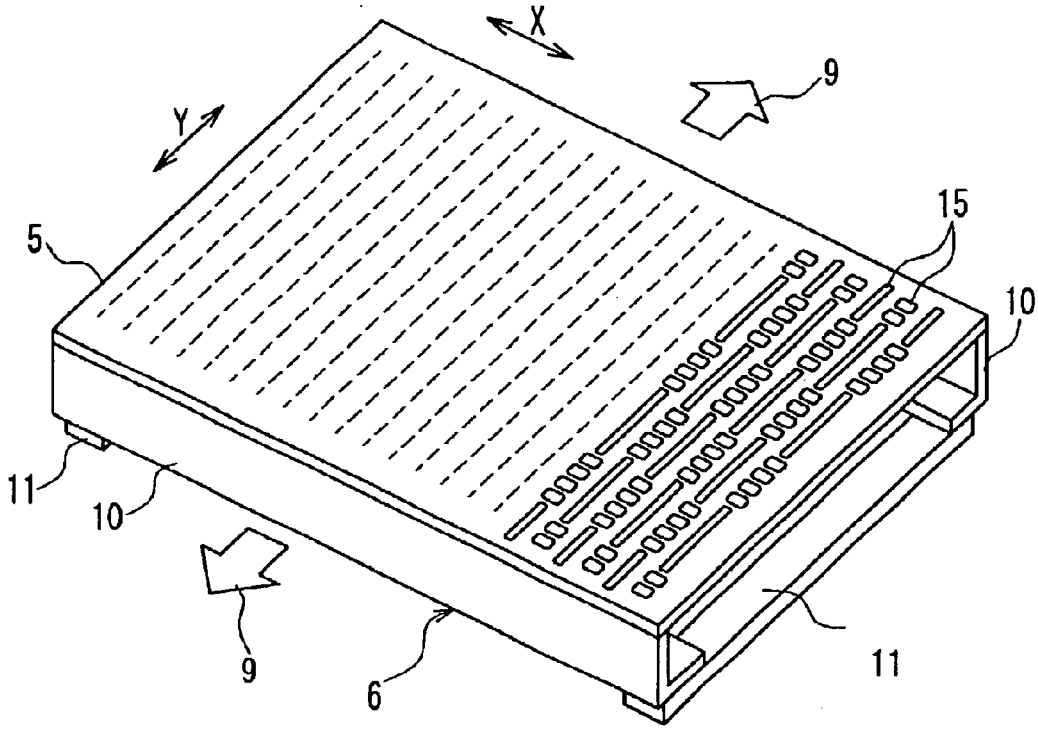
FIG. 7 is a perspective view showing an assembly including a shadow mask and a mask frame in a color cathode ray tube according to a second embodiment of the present invention.

FIG. 7 shows an assembly including the shadow mask 5 and the mask frame 6 according to the second embodiment. The assembly of FIG. 7 is different from that of FIG. 2 in the arrangement of apertures formed in the shadow mask 5. Members having functions equivalent to those in FIG. 2 are given the same numerals, and the description thereof will be omitted.

Figure 8:
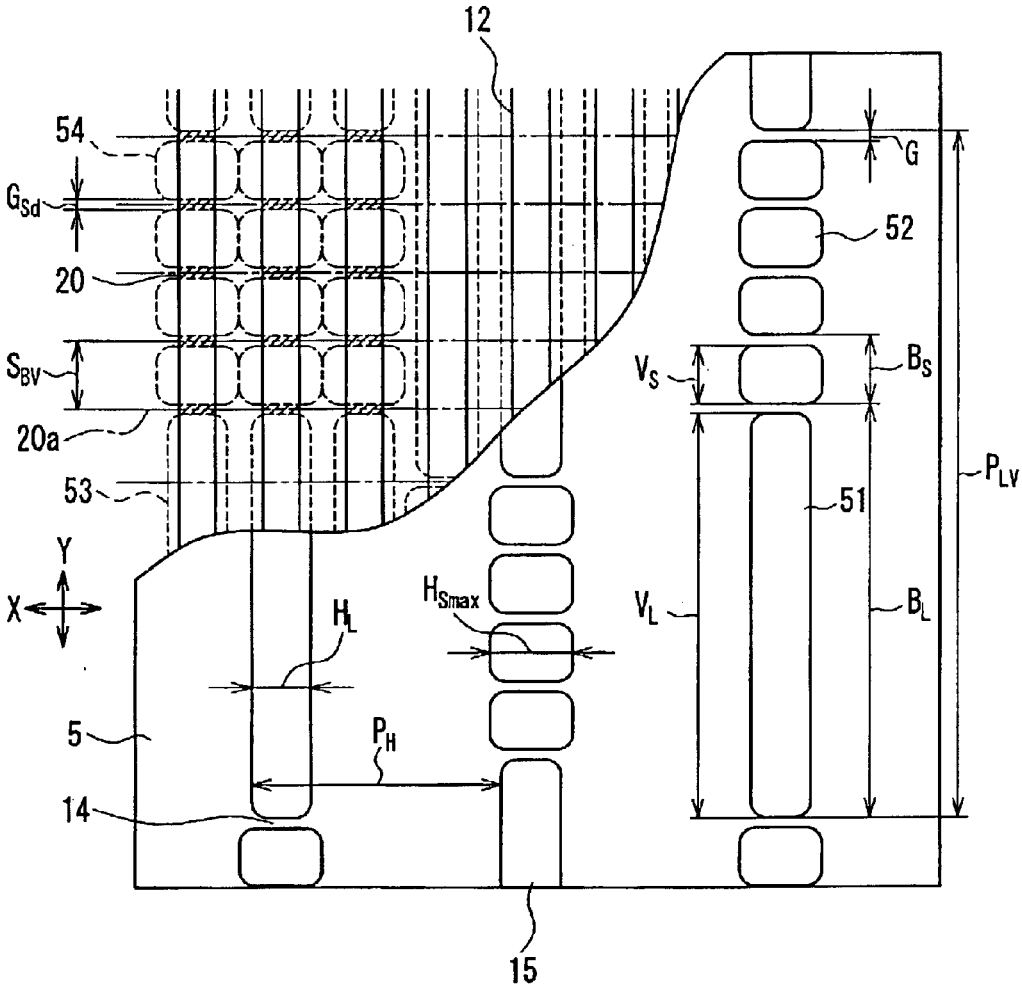
FIG. 8 is a schematic broken view showing the shadow mask, a phosphor screen and passed beams, which are electron beams that have passed through apertures and reached the phosphor screen, seen from an electron gun side in a color cathode ray tube according to the second embodiment of the present invention.

FIG. 8 is a schematic view showing the shadow mask 5, the phosphor screen 2*a* and passed beams, which are the electron beams that have passed through apertures and reached the phosphor screen 2*a*, seen from an electron gun side in a color cathode ray tube according to the present embodiment. The phosphor screen 2*a* is provided with a large number of vertically aligned striped phosphor lines 12. One array of apertures 15 of the shadow mask 5 corresponds to three phosphor lines 12. When the electron beams pass through apertures 51 and 52 of the shadow mask 5 and reach the phosphor screen 2*a* as passed beams 53 and 54, the phosphor lines 12 are illuminated. Since the electron beams are blocked by bridges 14 partitioning off two vertically adjacent apertures of the shadow mask 5, no electron beam reaches the regions on the phosphor lines 12 corresponding to the bridges 14, so that non-light-emitting portions 20 are formed.

Figure 18:
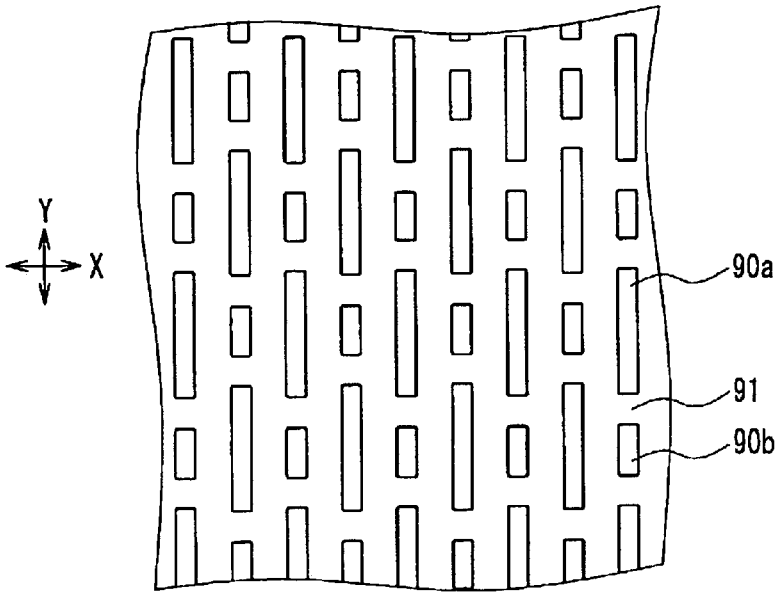
FIG. 18 PRIOR ART
FIG. 18 illustrates the shape and arrangement of apertures formed in a shadow mask in yet another conventional color cathode ray tube.

In the conventional shadow mask as shown in FIG. 18, these non-light-emitting portions 20 are perceived as shadows in a display image, causing a problem that black streaks extending in a horizontal direction (an X-axis direction) are found in a screen, for example. Reducing the vertical width of the bridge 91 can make the shadow of the bridge 91 less noticeable. However, for forming such a bridge 91, the shadow mask has to be made even thinner according to the current etching technique, which lowers the mechanical strength of the bridge 91, so that the bridge 91 may break more easily. Further, a thinner shadow mask increases a change in a path of the electron beam owing to geomagnetism, so that a component for correcting the change in the path becomes necessary, leading to a cost increase.

The present embodiment can make the black streaks caused by the non-light-emitting portions 20 less visible on the screen. A specific description thereof follows.

In the present embodiment, as the apertures for passing electron beams of the shadow mask 5, vertically elongated apertures 51 whose width in the vertical direction (the Y-axis direction) is larger than that in the horizontal direction (the X-axis direction) (in the following, simply referred to as "long apertures 51") and short apertures 52 whose vertical width is smaller than that of the long apertures 51 (in the following, simply referred to as "short apertures 52") are formed. One long aperture 51 and one or more short apertures 52 are formed alternately in each array of apertures 15.

For each of the bridges 14 in the shadow mask 5, a horizontal center line 14*a* passing through the center of each of the bridges 14 in the vertical direction is defined (see FIGS. 9 to 11 described later). All the horizontal center lines 14*a* are arranged away from each other by a substantially constant spacing (spacing $P_{BV}$) in the vertical direction. In other words, every bridge 14 formed on the shadow mask 5 is arranged substantially along any of a large number of the horizontal lines 14*a* that are equally spaced by the spacing $P_{BV}$ on the shadow mask 5. By such an arrangement of the bridges 14, the non-light-emitting portions 20 on the phosphor screen 2*a* also are arranged along any of a large number of horizontal lines 20*a* that are equally spaced on the phosphor screen 2*a*. As a result, the repetition of the non-light-emitting portions 20 becomes less perceivable as streaks by human eyes. An experiment has shown that the non-light-emitting portions 20 are easily perceivable as black streaks when a vertical spacing $S_{BV}$ between the horizontal lines 20*a* exceeds 1.2 mm, so it is preferable that the vertical spacing $S_{BV}$ between the horizontal lines 20*a* is not greater than 1.2 mm. Since the spacing $P_{BV}$ substantially matches the spacing $S_{BV}$, it also is preferable that the vertical spacing $P_{BV}$ between the horizontal center lines 14*a* of the bridges 14 is not greater than 1.2 mm.

In the present embodiment, the vertical spacing $P_{BV}$ between the horizontal center lines 14*a* of the bridges 14 is reduced, thereby suppressing the generation of black streaks. It may be sufficient to reduce the vertical widths of the apertures only for reducing the vertical spacing $P_{BV}$. However, in such a case, the number of the non-light-emitting portions 20 increases with the number of the bridges 14, so that the brightness of the display image is reduced. By providing not only the short apertures 52 but also the long apertures 51 in the array of apertures 15, the present invention reduces the vertical spacing $P_{BV}$ so as to prevent the generation of black streaks without lowering the brightness.

Furthermore, a horizontal maximum width $H_{Smax}$ of the short aperture 52 is larger than a horizontal basic width $H_L$ of the long aperture 51. A general method for forming the phosphor lines 12 is an exposure method of forming the phosphor lines 12 by exposure using the shadow mask 5 as a mask. In this exposure method, the widths of the phosphor lines to be formed vary with illumination. When all the apertures have equal horizontal widths, the illumination of light that has passed through the short aperture with a narrow spacing between the bridges is smaller than the illumination of light that has passed through the long aperture with a wider spacing between the bridges. In the present embodiment, since the horizontal maximum width $H_{Smax}$ of the short aperture 52 is larger than the horizontal basic width $H_L$ of the long aperture 51, the difference in illumination caused between the long aperture 51 and the short aperture 52 by the difference in their vertical widths can be reduced, thereby forming the phosphor lines 12 with a constant width.

Figure 9:
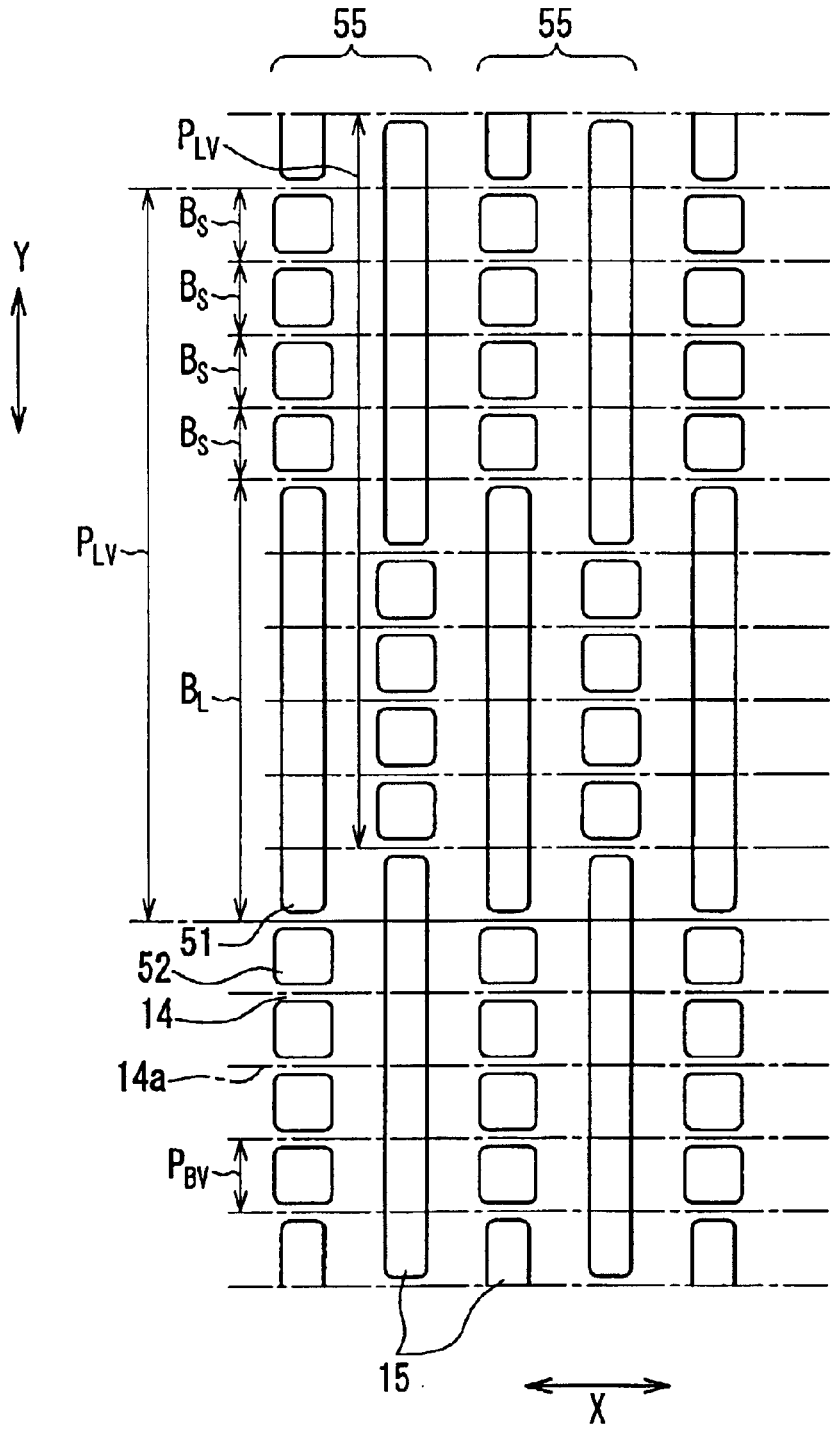
FIG. 9 illustrates an embodiment of an arrangement pattern of the apertures of the shadow mask in the color cathode ray tube according to the second embodiment of the present invention.

FIG. 9 illustrates a preferred embodiment of an arrangement pattern for apertures of the shadow mask. This embodiment has an arrangement pattern for apertures in which a repeating unit 55 consisting of two horizontally-adjacent arrays of apertures 15 is repeated along the horizontal direction. As shown in FIG. 9, $B_L$ is defined as the spacing between the horizontal center lines 14*a* of a pair of the bridges 14 sandwiching one long aperture 51, and $B_S$ is defined as the spacing between the horizontal center lines 14*a* of a pair of the bridges 14 sandwiching one short aperture 52. Further, N is defined as the number of the short apertures 52 (the number of successive short apertures 52) sandwiched between the two long apertures 51 that are closest in the vertical direction (N is an integer of 1 or larger), and $P_{LV}$ is defined as a vertical alignment pitch of the long apertures 51 ($P_{LV}=B_L+B_S\times N$). In the present embodiment, the alignment pitch $P_{LV}$ of the long apertures 51 is substantially constant in all the arrays of apertures 15. Moreover, in all the arrays of apertures 15, $B_L=B_S\times(N+2)$ is satisfied substantially. According to the present embodiment, the vertical positions of the bridges 14 included in the two adjacent arrays of apertures 15 do not match. As a result, even when the temperature of the shadow mask 5 rises owing to the electron beams blocked by the shadow mask 5 during an operation of the color cathode ray tube, this temperature rise is not easily transmitted in the horizontal direction, so that it becomes possible to prevent the shadow mask 5 from being deformed due to thermal expansion.

In the embodiment illustrated in FIG. 9, it is preferable that the long apertures 51 and the short apertures 52 are arranged such that the short apertures 52 included respectively in arbitrary two horizontally-adjacent arrays of apertures 15 do not align horizontally, that is, the vertical positions of the short apertures 52 do not overlap. In this way, the vertical positions of the bridges 14 included respectively in the two adjacent arrays of apertures do not match either, so that it becomes possible to prevent the shadow mask 5 from being deformed due to thermal expansion.

In the embodiment illustrated in FIG. 9, the spacing $P_{BV}$ between the horizontal center lines 14*a* of the bridges 14 equals the spacing $B_S$ between the horizontal center lines 14*a* of the pair of bridges 14 sandwiching the short aperture 52 ($P_{BV}=B_S$).

Figure 10:
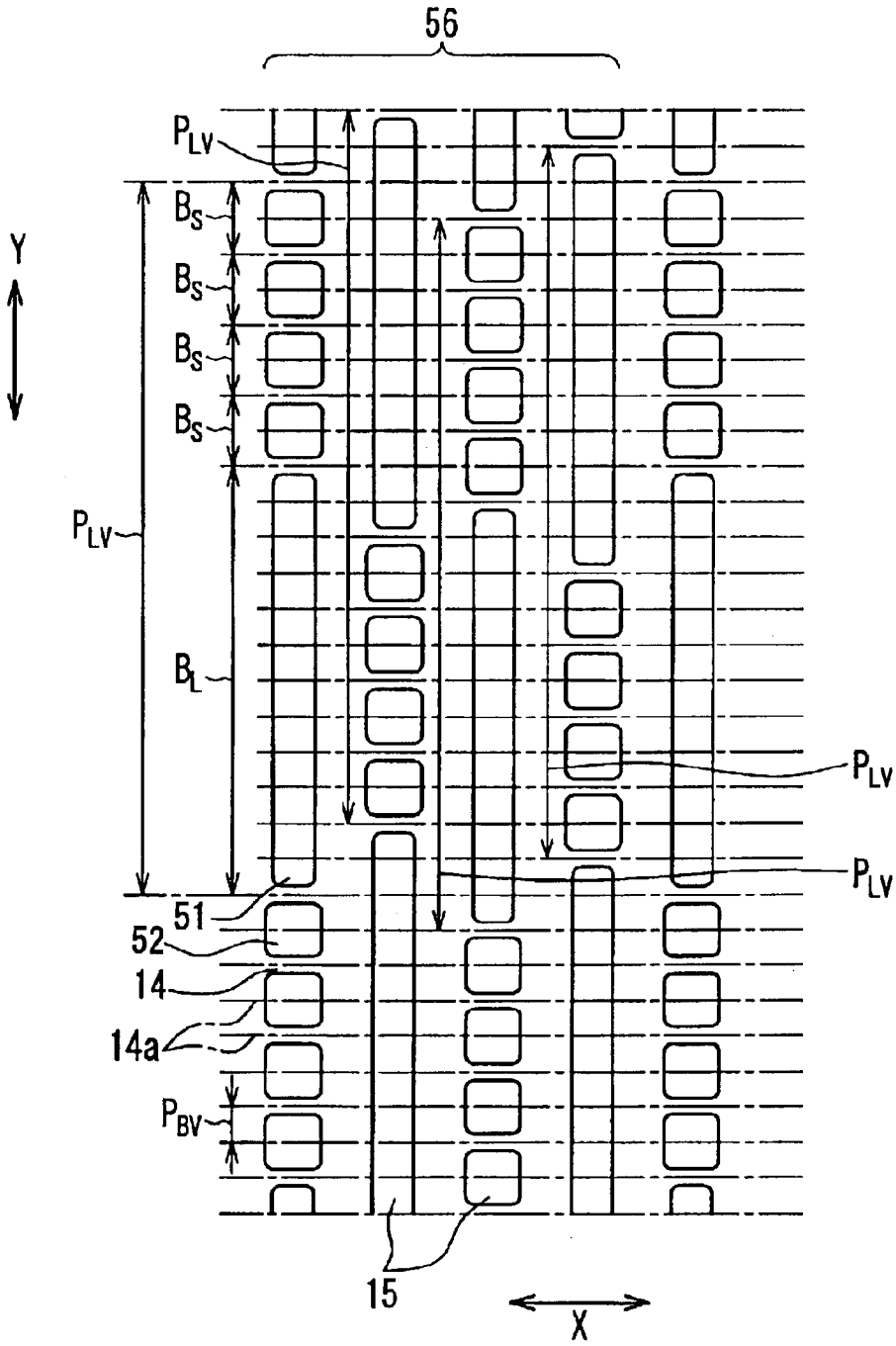
FIG. 10 illustrates an arrangement pattern for apertures of a shadow mask in another color cathode ray tube according to the second embodiment of the present invention.

FIG. 10 illustrates another preferred embodiment of an arrangement pattern for apertures of the shadow mask. This embodiment has an arrangement pattern for apertures in which a repeating unit 56 consisting of four horizontally-successive arrays of apertures 15 is repeated along the horizontal direction. Furthermore, the alignment pitch $P_{LV}$ of the long apertures 51 is substantially the same in all the arrays of apertures 15. In addition, the spacing $P_{BV}$ between the horizontal center lines 14*a* of the bridges 14 and the spacing $B_S$ between the horizontal center lines 14*a* of a pair of the bridges 14 sandwiching the short aperture 52 substantially satisfy $B_S=2\times P_{BV}$ in all the arrays of apertures 15. According to the present embodiment, since the bridges 14 in every fourth array have the same vertical positions, contrast of the black streaks can be lowered compared with the configuration of FIG. 9, in which the bridges in every second array have the same vertical positions, and the moiré fringes caused by the interference between the scanning lines and the bridges become less visible. In the present embodiment, it also is preferable that the short apertures 52 included respectively in two arbitrary horizontally-adjacent arrays of apertures 15 do not align horizontally, as in the embodiment illustrated in FIG. 9. Moreover, it is preferable that $B_L=B_S\times(N+2)$ is satisfied substantially in all the arrays of apertures 15, as in the embodiment illustrated in FIG. 9.

Figure 11:
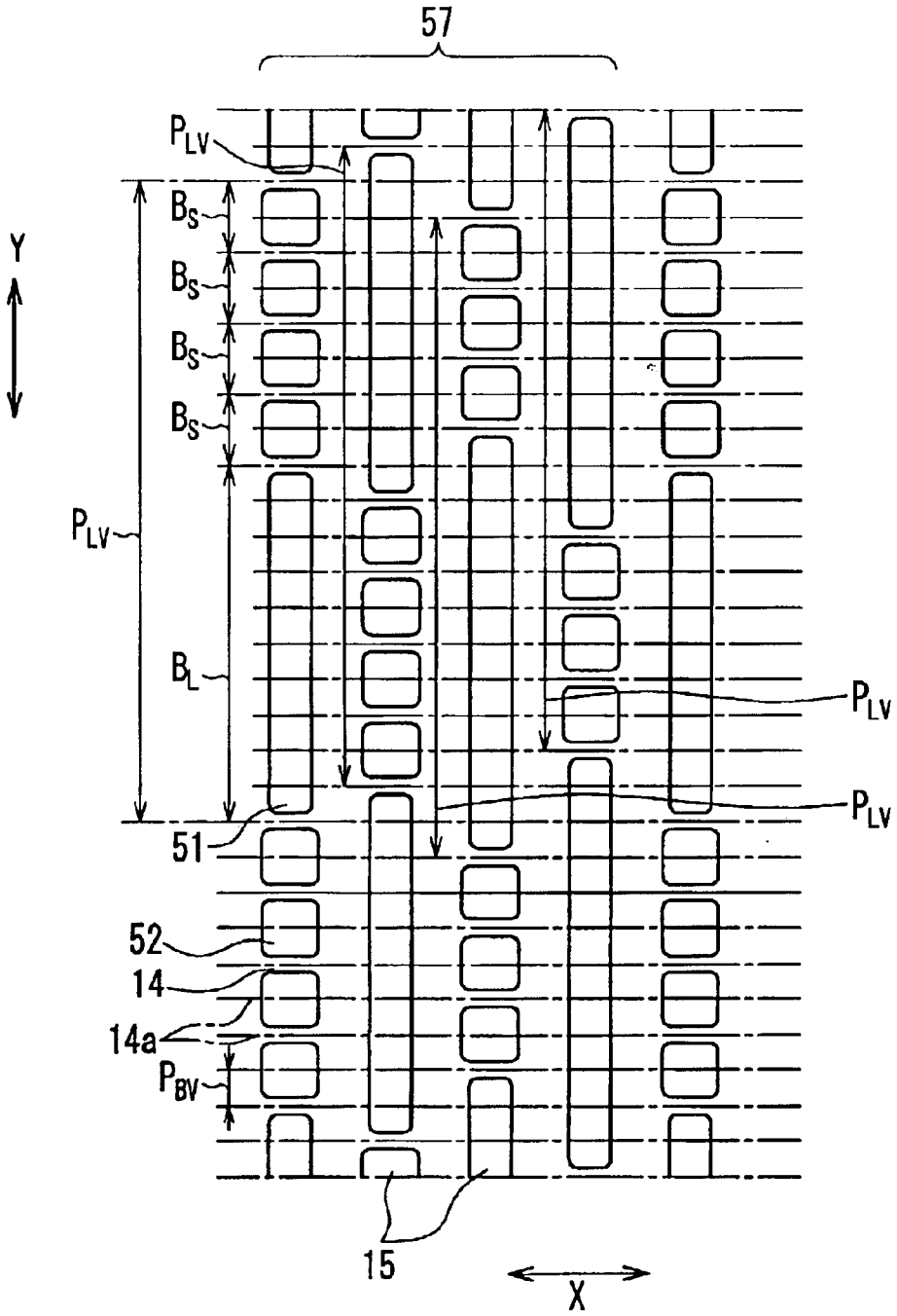
FIG. 11 illustrates an arrangement pattern for apertures of a shadow mask in yet another color cathode ray tube according to the second embodiment of the present invention.

FIG. 11 illustrates yet another preferred embodiment of an arrangement pattern for apertures of the shadow mask. This embodiment has an arrangement pattern for apertures in which a repeating unit 57 consisting of four horizontally-successive arrays of apertures 15 is repeated along the horizontal direction. Furthermore, the alignment pitch $P_{LV}$ of the long apertures 51 is substantially the same in all the arrays of apertures 15. Moreover, the number N of successive short apertures 52 is not the same for each of the four arrays of apertures 15 constituting the repeating unit 57 (in other words, in the four arrays of apertures 15 constituting the repeating unit 57, the spacing $B_L$ between the horizontal center lines of a pair of the bridges 14 sandwiching one long aperture 51 is not the same). According to the present embodiment, since the bridges 14 in every fourth array have the same vertical positions, contrast of the black streaks can be lowered and the moiré fringes caused by the interference between the scanning lines and the bridges become less visible, as in the embodiment illustrated in FIG. 10. In the present embodiment, it also is preferable that the short apertures 52 included respectively in arbitrary two horizontally-adjacent arrays of apertures 15 do not align horizontally, as in the embodiment illustrated in FIG. 9. In addition, it is preferable that the spacing $P_{BV}$ between the horizontal center lines 14*a* of the bridges 14 and the spacing $B_S$ between the horizontal center lines 14*a* of a pair of the bridges 14 sandwiching the short aperture 52 substantially satisfy $B_S=2\times P_{BV}$ in all the arrays of apertures 15, as in the embodiment illustrated in FIG. 10.

Figure 12:
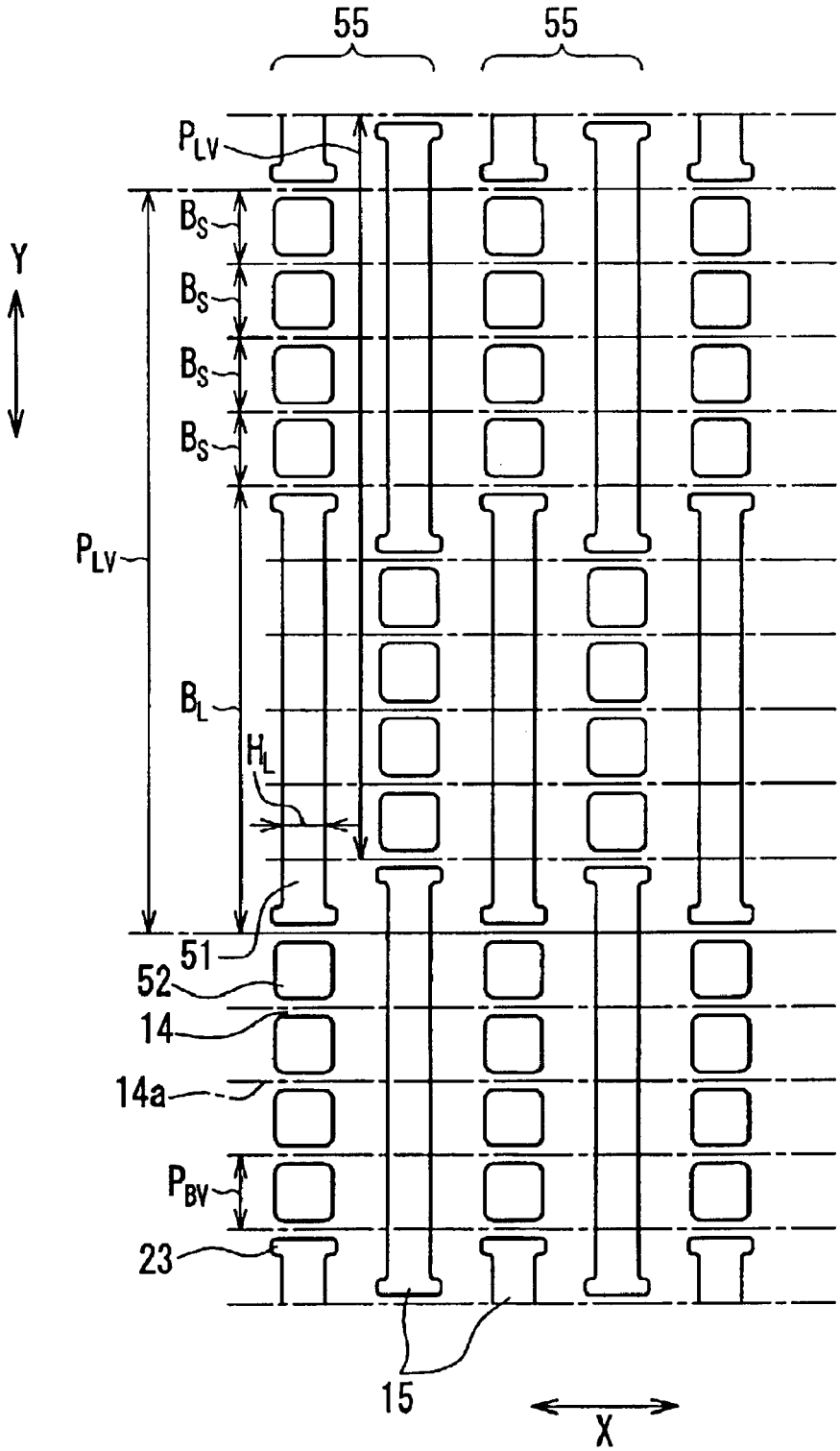
FIG. 12 illustrates an arrangement pattern for apertures of a shadow mask in yet another color cathode ray tube according to the second embodiment of the present invention.

FIG. 12 illustrates a preferred embodiment of an aperture shape of the shadow mask. As shown in FIG. 12, the long aperture 51 may be formed into a substantially "I" shape by expanding the horizontal width thereof at both ends in the vertical direction or their vicinities. By expanding the horizontal width in the vicinity of the bridges 14, it becomes possible to compensate for the illumination of light in portions of the short apertures 52 and the bridges 14 when forming the phosphor lines 12 by the exposure method, thereby achieving still more constant widths of the phosphor lines 12. When the long aperture 51 has such a substantially "I" shape, the horizontal basic width $H_L$ of the long aperture 51 is defined by a horizontal width in a portion other than the wider portions (protruding portions 23) at both ends. Although FIG. 12 illustrates an example in which the long aperture 51 in the arrangement pattern for apertures shown in FIG. 9 is formed into a substantially "I" shape, the long apertures 51 in the arrangement patterns of apertures shown in FIGS. 10 and 11 also may be formed into a substantially "I" shape.

FIGS. 13 and 14 illustrate other preferred embodiments of an aperture shape of the shadow mask. FIG. 13 is different from FIG. 8 showing substantially rectangular short apertures 52, in that the horizontal width of the short aperture 52 in the vicinity of the bridges 14 is slightly larger than that in the central part in the vertical direction. In the case of FIG. 13, the horizontal maximum width $H_{Smax}$ of the short aperture 52 is defined by the width of a part whose horizontal width is largest in the vicinity of the bridges 14. FIG. 14 is different from FIG. 8 in that the long apertures 51 have a shape similar to that in FIG. 12 and the short apertures 52 have a shape similar to that in FIG. 13. In FIGS. 13 and 14, the horizontal maximum width $H_{Smax}$ of the short aperture 52 also is larger than the horizontal basic width $H_L$ of the long aperture 51. As shown in FIGS. 13 and 14, by expanding the horizontal width of the short aperture 52 (preferably, the long aperture 51 as well) in the vicinity of the bridges 14, it becomes possible to achieve still more constant widths of the phosphor lines 12 when forming the phosphor lines 12 by the exposure method. Although FIG. 13 illustrates an example in which the horizontal width of the short aperture 52 is expanded in the vicinity of the bridges 14 in the arrangement patterns of apertures shown in FIGS. 8 and 9, the short apertures 52 in the arrangement patterns of apertures shown in FIGS. 10 and 11 also may be formed into a shape similar to that in FIG. 13.

Next, as a specific example of the second embodiment of the present invention, a color cathode ray tube with a 76-cm-diagonal screen and a deflection angle of 100° will be described.

A shadow mask for the color cathode ray tube of the present example corresponding to the embodiment shown in FIG. 9 had the arrays of apertures 15 with a horizontal pitch $P_H$=0.5 mm, the long apertures 51 with a horizontal basic width $H_L$=0.125 mm, the bridges 14 with a vertical width G=0.050 mm, and the short apertures 52 with a horizontal maximum width $H_{Smax}$=0.135 mm. The horizontal center lines 14*a* of a pair of the bridges 14 sandwiching the long aperture 51 were spaced apart by the spacing $B_L$=3.6 mm, and the horizontal center lines 14*a* of a pair of the bridges 14 sandwiching the short aperture 52 were spaced apart by the spacing $B_S$=0.60 mm. The number N of the short apertures 52 sandwiched between the two vertically-adjacent long apertures 51 was 4. The shadow mask 5 and the phosphor screen 2*a* were spaced apart by 11 mm.

During an operation of this color cathode ray tube, the vertical width $G_{sd}$ of the shadow 20 of the bridge 14 having a vertical width G of 0.050 mm (the non-light-emitting portion 20) on the phosphor screen 2*a* was 0.045 mm, and five shadows 20 were arranged successively at a vertical pitch $S_{BV}$ of 0.6 mm. The repetition of these shadows 20 of the bridges was almost unperceivable as streaks in a normal use of the color cathode ray tube. Moreover, since the number of the bridges 14 was large in the part in which the short apertures 52 were provided successively in the vertical direction, the mechanical strength of the shadow mask 5 improved. Accordingly, there was little possibility of breaking, thus giving a promise of higher yields in the manufacturing process. Further, the vibration characteristics of the shadow mask 5 also improved. Consequently, it was found that, according to the present invention, black streaks owing to the repetition of the shadows of the bridges 14 were not perceived.

A shadow mask for the color cathode ray tube of the present example corresponding to the embodiment shown in FIG. 11 had the arrays of apertures 15 with a horizontal pitch $P_H$=0.5 mm, the long apertures 51 with a horizontal basic width $H_L$=0.125 mm, the bridges 14 with a vertical width G=0.045 mm, and the short apertures 52 with a horizontal maximum width $H_{Smax}$=0.132 mm. The horizontal center lines 14*a* of a pair of the bridges 14 sandwiching the short aperture 52 were spaced apart by the spacing $B_S$=0.95 mm. In two arrays of apertures 15 of the four arrays of apertures 15 constituting the repeating unit 57, the number N of the short apertures 52 sandwiched between the two long apertures 51 that are closest in the vertical direction was 2, whereas in the other two arrays of apertures 15, N=3. In the arrays of apertures whose N=2, the horizontal center lines 14*a* of a pair of the bridges 14 sandwiching the long aperture 51 were spaced apart by the spacing $B_L$=4.75 mm, whereas in the arrays of apertures whose N=3, the spacing $B_L$=3.80 mm. The shadow mask 5 and the phosphor screen 2*a* were spaced apart by 11 mm.

During an operation of this color cathode ray tube, the vertical width $G_{sd}$ of the shadow 20 of the bridge 14 having a vertical width G of 0.045 mm (the non-light-emitting portion 20) on the phosphor screen 2*a* was 0.040 mm, and three or four shadows 20 were arranged successively at a vertical pitch $S_{BV}$ of 0.95 mm. The repetition of these shadows 20 of the bridges was almost unperceivable as streaks in a normal use of the color cathode ray tube. Also, few moiré fringes were found. Moreover, since the number of the bridges 14 was large in the part in which the short apertures 52 are provided successively in the vertical direction, the mechanical strength of the shadow mask 5 improved. Accordingly, there was little possibility of breaking, thus giving a promise of higher yields in the manufacturing process. Further, the vibration characteristics of the shadow mask 5 also improved. Consequently, it was found that, according to the present invention, black streaks owing to the repetition of the shadows of the bridges 14 or moiré fringes were not perceived.

The invention may be embodied in other specific forms without departing from the spirit or essential characteristics thereof The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A color cathode ray tube comprising:

a panel whose inner surface is provided with a phosphor screen; and a shadow mask facing the phosphor screen;

wherein the shadow mask has a plurality of arrays of apertures, the arrays of apertures have a vertically long aperture, a vertically short aperture and a bridge between these apertures, in each of the arrays of apertures, one long aperture and one or more short apertures are arranged alternately, the one long aperture being the vertically long aperture and the one or more short apertures each being the vertically short aperture, and a horizontal maximum width $H_{Smax}$ of the short aperture is larger than a horizontal basic width $H_L$ of the long aperture.

2. The color cathode ray tube according to claim 1, satisfying $0.9<S_1/S_2<1.1$, wherein $S_1$ represents a total area of all the bridges sandwiched between two long apertures that are closest in a vertical direction and $S_2$ represents a total area of portions of all the short apertures, sandwiched between the two long apertures, that protrude horizontally outward beyond extensions of a pair of basic vertical sides defining the horizontal basic width $H_L$ of the long aperture.

3. The color cathode ray tube according to claim 1, satisfying $L_1<\lambda_Y \times Y$, wherein $L_1$ represents a distance between two long apertures that are closest in a vertical direction, $\lambda_Y$ represents a vertical magnification of a passed beam on the phosphor screen with respect to the aperture of the shadow mask and Y represents a relative amount of vertical movement when exposure is performed while moving one of the shadow mask and the panel relative to the other in the vertical direction.

4. The color cathode ray tube according to claim 1, wherein the long aperture has a horizontal width larger than the horizontal basic width $H_L$ at both ends in a vertical direction or their vicinities.

5. The color cathode ray tube according to claim 4, satisfying $0.9<S_{11}/S_{22}<1.1$, wherein $S_{11}$ represents a total area of all the bridges sandwiched between two long apertures that are closest in a vertical direction and $S_{22}$ represents a total area of portions of the long aperture protruding horizontally outward beyond a pair of basic vertical sides defining the horizontal basic width $H_L$ and portions of all the short apertures, sandwiched between the two long apertures, that protrude horizontally outward beyond extensions of the pair of basic vertical sides.

6. The color cathode ray tube according to claim 4, satisfying $L_1+V_{LaT}<\lambda_Y\times Y$, wherein $L_1$ represents a distance between two long apertures that are closest in a vertical direction, $V_{LaT}$ represents a total vertical length of portions having a horizontal width larger than the horizontal basic width $H_L$ in the long apertures, $\lambda_Y$ represents a vertical magnification of a passed beam on the phosphor screen with respect to the aperture of the shadow mask and Y represents a relative amount of vertical move when exposure is performed while moving one of the shadow mask and the panel relative to the other in the vertical direction.

7. The color cathode ray tube according to claim 1, satisfying $1.0\leqq H_{Smax}/H_L\leqq 1.5$.

8. The color cathode ray tube according to claim 1, wherein a vertical spacing $P_{BV}$ between horizontal center lines is substantially constant, where the horizontal center lines are each defined as a line passing through a center in a vertical direction of each of the bridge in the shadow mask.

9. The color cathode ray tube according to claim 8, wherein the shadow mask has an arrangement pattern for apertures in which a repeating unit consisting of two horizontally-adjacent arrays of the plurality of arrays of apertures is repeated along a horizontal direction, and an alignment pitch $P_{LV}$ of the long apertures is substantially the same in all the arrays of apertures, and $B_L=B_S\times(N+2)$ is satisfied substantially in all the arrays of apertures, where $B_L$ represents a spacing between the horizontal center lines of a pair of the bridges sandwiching the long aperture, $B_S$ represents a spacing between the horizontal center lines of a pair of the bridges sandwiching the short aperture, N represents the number of the short apertures sandwiched between two long apertures that are closest in a vertical direction where N is an integer of 1 or larger and $P_{LV}$ represents a vertical alignment pitch of the long apertures where $P_{LV}=B_L+B_S\times N$.

10. The color cathode ray tube according to claim 8, wherein the shadow mask has an arrangement pattern for apertures in which a repeating unit consisting of four horizontally-successive arrays of the plurality of arrays of apertures is repeated along a horizontal direction, and a vertical alignment pitch $P_{LV}$ of the long apertures is substantially the same in all the arrays of apertures, and $B_S=2\times P_{BV}$ is satisfied substantially with respect to the vertical spacing $P_{BV}$ between the horizontal center lines in all the arrays of apertures, where $B_S$ represents a spacing between the horizontal center lines of a pair of the bridges sandwiching the short aperture.

11. The color cathode ray tube according to claim 8, wherein the shadow mask has an arrangement pattern for apertures in which a repeating unit consisting of four horizontally-successive arrays of the plurality of arrays of apertures is repeated along a horizontal direction, and a vertical alignment pitch $P_{LV}$ of the long apertures is substantially the same in all the arrays of apertures, and a number N is not the same for each of the four arrays of apertures constituting the repeating unit, where N represents the number of the short apertures sandwiched between two long apertures that are closest in a vertical direction where N is an integer of 1 or larger.

12. The color cathode ray tube according to claim 1, wherein the short apertures included respectively in two arbitrary horizontally-adjacent arrays of the plurality of arrays of apertures do not align horizontally.

* * * * *